US010605206B2

(12) United States Patent
Nishiura et al.

(10) Patent No.: US 10,605,206 B2
(45) Date of Patent: Mar. 31, 2020

(54) FUEL VAPOR PROCESSING APPARATUS

(71) Applicant: AISAN KOGYO KABUSHIKI KAISHA, Obu-shi, Aichi-ken (JP)

(72) Inventors: Kazuki Nishiura, Nagoya (JP); Shinji Murai, Obu (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 340 days.

(21) Appl. No.: 14/978,734

(22) Filed: Dec. 22, 2015

(65) Prior Publication Data

US 2016/0186700 A1 Jun. 30, 2016

(30) Foreign Application Priority Data

Dec. 25, 2014 (JP) ..... 2014-263145
Feb. 10, 2015 (JP) ..... 2015-024086

(51) Int. Cl.
*F02M 25/08* (2006.01)

(52) U.S. Cl.
CPC ..... *F02M 25/0854* (2013.01); *F02M 25/089* (2013.01); *F02M 25/0836* (2013.01)

(58) Field of Classification Search
CPC ..... B60K 15/03504; B60K 15/03519; B60K 2015/03514; F02D 41/0032; F02D 41/004; F02D 41/003; B01D 2259/4516
See application file for complete search history.

(56) References Cited

U.S. PATENT DOCUMENTS 5,584,278 A * 12/1996 Satoh ..... B60K 15/03519 123/516
5,950,659 A * 9/1999 Szlaga ..... F16K 24/048 137/202
6,047,687 A * 4/2000 Ishikawa ..... F02M 25/0854 123/518
6,116,221 A * 9/2000 Matsumoto ..... F02B 17/005 123/295
6,514,326 B1 2/2003 Hara et al.
9,284,923 B2 3/2016 Kimoto et al.
9,346,351 B2 * 5/2016 Onodera ..... B60K 15/03519
9,828,952 B2 * 11/2017 Takahashi ..... F02M 25/0854
(Continued)

FOREIGN PATENT DOCUMENTS

DE 60019882 T2 2/2006
DE 102013016984 A1 4/2014
(Continued)

OTHER PUBLICATIONS

Office Action dated May 23, 2016, received for German Application No. 102015016633.6.
(Continued)

*Primary Examiner* — Carl C Staubach
(74) *Attorney, Agent, or Firm* — Conley Rose, P.C.

(57) ABSTRACT

A fuel vapor processing apparatus may include a canister and a valve device. The canister may include a canister case and may adsorb fuel vapor and allow desorption of fuel vapor. The valve device may include a valve housing defining a fuel vapor passage therein. A valve may be disposed within the valve housing and may control a flow of fuel vapor through the fuel vapor passage. The valve housing may be directly connected to the canister case, so that the fuel vapor passage communicates within the canister case.

21 Claims, 7 Drawing Sheets

(56) References Cited

U.S. PATENT DOCUMENTS

| | | | | |
|---|---|---|---|---|
| 9,902,258 | B2 * | 2/2018 | Young | B60K 15/03519 |
| 2010/0269921 | A1 * | 10/2010 | Pifer | B60K 15/03519 137/487.5 |
| 2016/0245238 | A1 * | 8/2016 | Ueda | F02M 25/0809 |

FOREIGN PATENT DOCUMENTS

| | | | |
|---|---|---|---|
| JP | 3-37368 | A | 2/1991 |
| JP | 10-325369 | A | 12/1998 |
| JP | H10-325369 | A | 12/1998 |
| JP | 2001-99017 | A | 4/2001 |
| JP | 2001-152977 | A | 6/2001 |
| JP | 2005-54704 | A | 3/2005 |
| JP | 2011-169276 | A | 9/2011 |
| JP | 2013-113197 | A | 6/2013 |
| JP | 2014-77422 | A | 5/2014 |
| WO | 2002-092989 | A1 | 11/2002 |

OTHER PUBLICATIONS

Japanese Office Action dated Oct. 19, 2017, and English translation dated Oct. 24, 2017, for Patent Application No. 2014-263145.
Japanese Office Action dated Nov. 8, 2017, and English translation dated Nov. 16, 2017, for Patent Application No. 2015-024086.
Chinese First Office Action dated Dec. 13, 2017, received for Application No. 201610056497.8.
German Office Action dated Jul. 2, 2019, for Application No. DE 10 2015 016633.6, and English translation.

* cited by examiner

FUEL VAPOR PROCESSING APPARATUS

CROSS-REFERENCE TO RELATED APPLICATIONS

This application is based upon and claims priorities to Japanese Patent Application Serial No. 2014-263145 filed on Dec. 25, 2014 and Japanese Patent Application Serial No. 2015-024086 filed on Feb. 10, 2015, and the contents of each are incorporated herein by reference in their entirety for all purposes.

STATEMENT REGARDING FEDERALLY SPONSORED

RESEARCH OR DEVELOPMENT
Not applicable.

BACKGROUND

The disclosure generally relates to a fuel vapor processing apparatus that may be mounted to a vehicle, such as an automobile.

Fuel vapor processing apparatuses are known that may be mounted to vehicles, such as automobiles, for processing fuel vapor, such as gasoline vapor, produced in fuel tanks. Japanese Laid-Open Patent Publication No. 2013-113197 discloses a fuel vapor processing apparatus including a canister and a closing valve device. The canister can adsorb fuel vapor produced in a fuel tank. The closing valve device can close a fuel vapor passage that connects between the fuel tank and the canister for interrupting flow of fuel vapor through the fuel vapor passage. It has been known to use an electromagnetic valve for the closing valve device. The electromagnetic valve may include a valve member that is moved relative to a valve seat by a magnetic force produced by an electromagnet, in order to open and close the fuel vapor passage.

However, the closing valve device utilizing the electromagnetic valve may naturally generate "hitting sounds" or similar noises of the valve member as the valve member moves to operate. In order to reduce or inhibit rumbling of the hitting sounds, it may be necessary or preferable to mount the closing valve device within the vehicle at a different position from the canister. However, it can be cumbersome to mount the canister and the closing valve of the fuel vapor processing apparatus at different positions from each other.

In view of the challenges discussed above, there is a need in the art for a fuel vapor processing apparatus that can be easily mounted to a vehicle.

SUMMARY

In one aspect according to the present disclosure, a fuel vapor processing apparatus may include a canister and a valve device. The canister may include a canister case and may adsorb fuel vapor and allow desorption of fuel vapor. The valve device may include a valve housing defining a fuel vapor passage therein. A valve may be disposed within the valve housing and may control a flow of fuel vapor through the fuel vapor passage. The valve housing may be directly connected to the canister case, so that the fuel vapor passage communicates within the canister case.

DETAILED DESCRIPTION OF EXEMPLARY EMBODIMENTS

Figure 1:
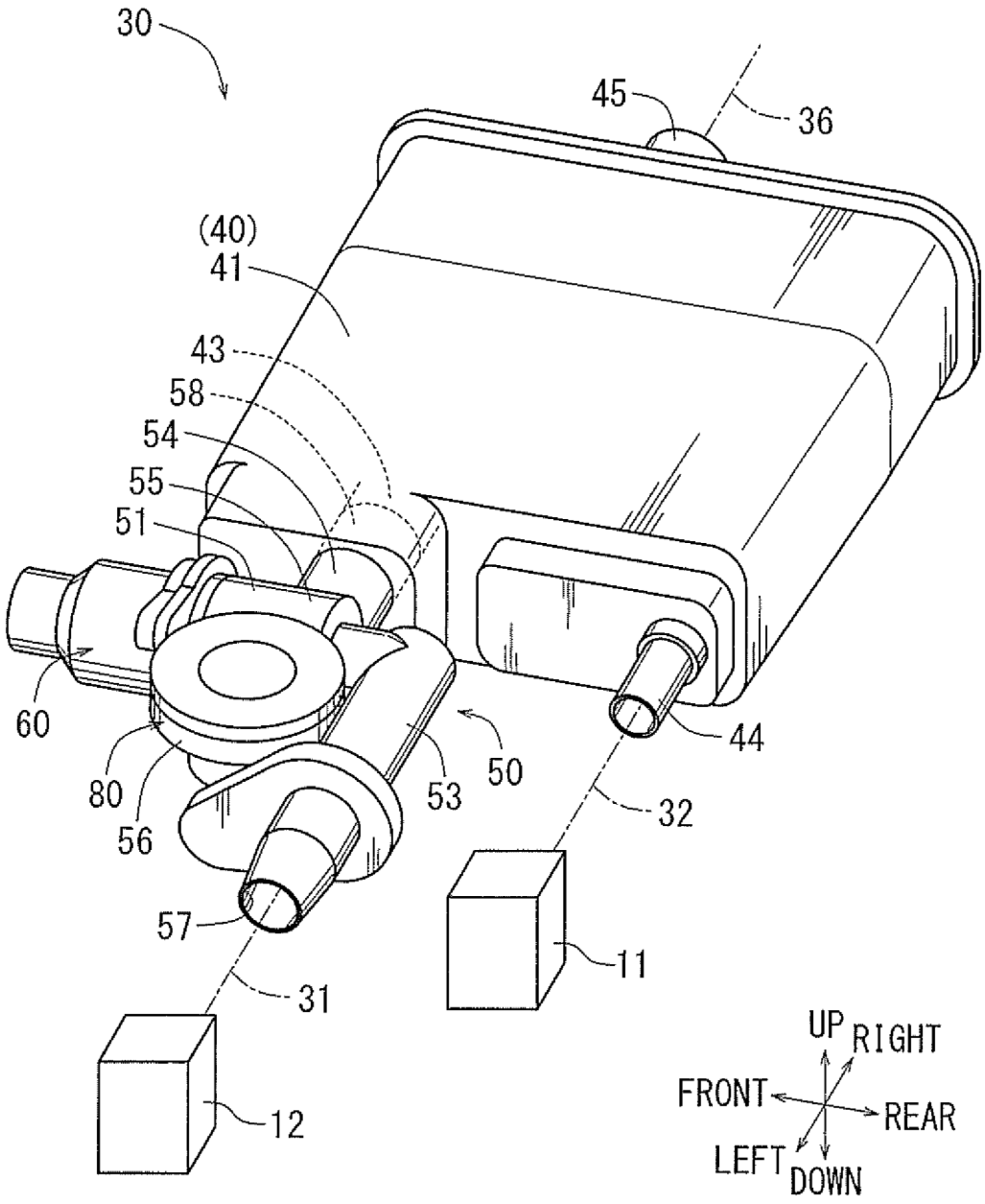
FIG. 1 is a perspective view showing an external appearance of a fuel vapor processing apparatus according to a representative embodiment.

In one embodiment, a fuel vapor processing apparatus may include a canister and a valve device. The canister may include a canister case and may adsorb fuel vapor and allow desorption of fuel vapor. The valve device may be connected to a fuel tank and may include a valve housing having a fuel vapor passage defined therein. A motor operated valve may be disposed and supported within the valve housing. The motor operated valve may include a valve seat and a valve member disposed in the fuel vapor passage. An electric motor may be coupled to the valve member and may move the valve member to change a position of the valve member relative to the valve seat, so that the fuel vapor passage is opened and closed according to a change of the position of the valve member. The valve housing may be integrated with the canister case, so that the fuel vapor passage communicates within the canister case to allow fuel vapor produced in the fuel tank to flow into the canister via the fuel vapor passage when the valve device is connected to the fuel tank.

With this arrangement, the canister and the valve device having the motor operated valve can be handled as a single component when the fuel vapor processing apparatus is mounted to a vehicle. Therefore, the operation for mounting the fuel vapor processing apparatus can be easily performed. It may be also possible to simplify a piping structure for the fuel vapor passage and to reduce a loss in pressure of the fuel vapor flowing through the piping structure. Further, it may be possible to reduce a resistance against flow of fuel during a refueling operation.

The valve housing may further include a tank-side port, and a canister-side port defining a tank-side opening and a canister-side opening, respectively. The fuel vapor passage may be in communication with the tank-side opening and the canister-side opening. The canister case may include a tank port. The canister-side port of the valve housing may be directly connected to the tank port of the canister.

With this arrangement, it may be possible to minimize a distance between the valve device and the canister. Further, this arrangement may also reduce an amount of fuel vapor remaining between the motor operated valve and the canister when the motor operated valve is closed. It may be also possible to reduce a passage cross-sectional area of the fuel vapor passage and to minimize the size of the motor that drives or powers the valve member.

The valve housing may further include a sub passage defined therein and connected to the fuel vapor passage so as to bypass the motor operated valve. A mechanical valve may be disposed and supported within the valve housing and may open and close the sub passage according to a pressure of the fuel vapor flowing through the sub passage.

With this arrangement, the canister and the valve device including the motor operated valve and the mechanical valve may be handled or manipulated as a single component when the fuel vapor processing apparatus is mounted to a vehicle. Therefore, the operation for mounting the fuel vapor processing apparatus, including the canister and the valve device with two different valves, can be easily performed.

The valve housing may include a motor support portion that supports the electric motor of the motor operated valve. The valve housing may be connected to the canister case via a connecting portion of the valve housing. The connecting portion may comprise a different portion from the motor support portion.

With this arrangement, it may be possible to inhibit or minimize the transmission of noises or vibrations generated by the motor to the canister\. As a result, it may be possible to reduce noises and vibrations of the fuel vapor processing apparatus.

Figure 2:
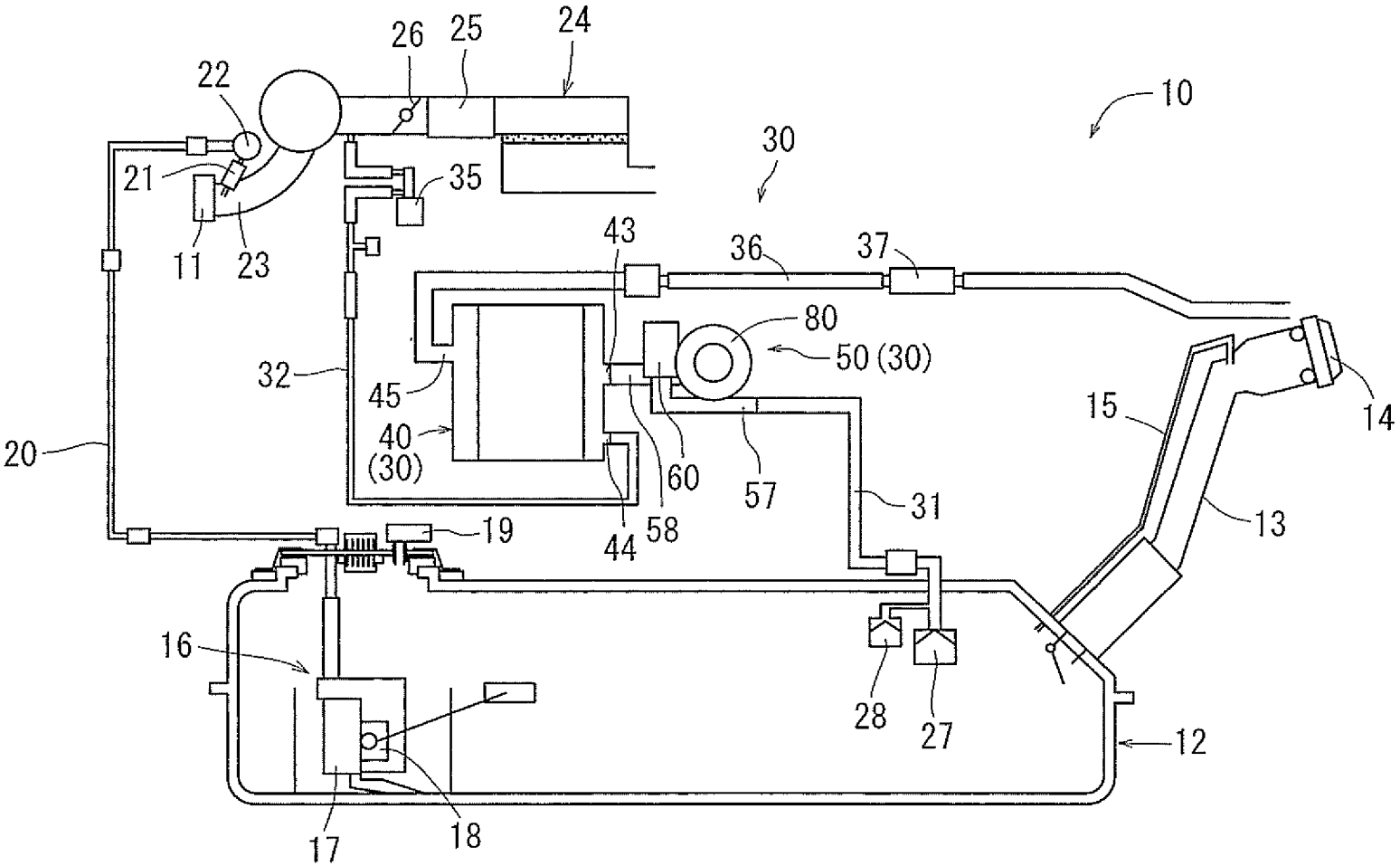
FIG. 2 is a schematic view of an embodiment of an engine system including the fuel vapor processing apparatus mounted thereto.
Figure 3:
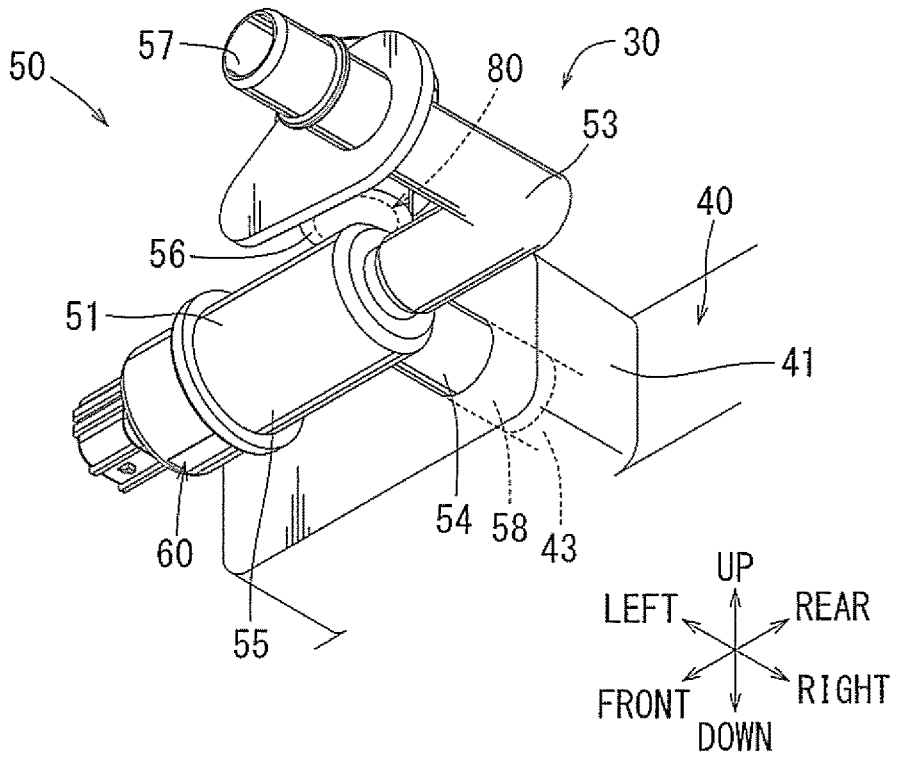
FIG. 3 is a perspective view of an embodiment of a closing valve device of the fuel vapor processing apparatus.
Figure 4:
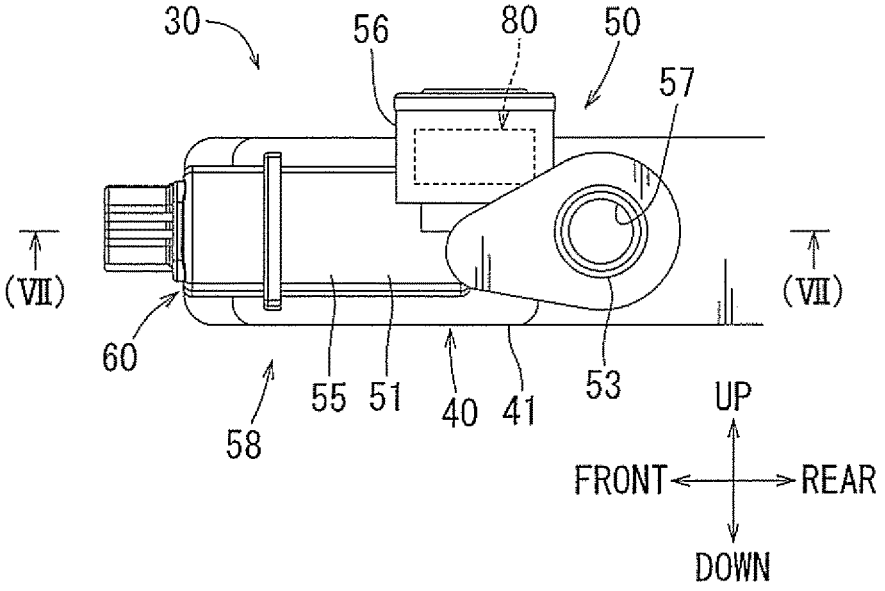
FIG. 4 is a left side view of the closing valve device.
Figure 5:
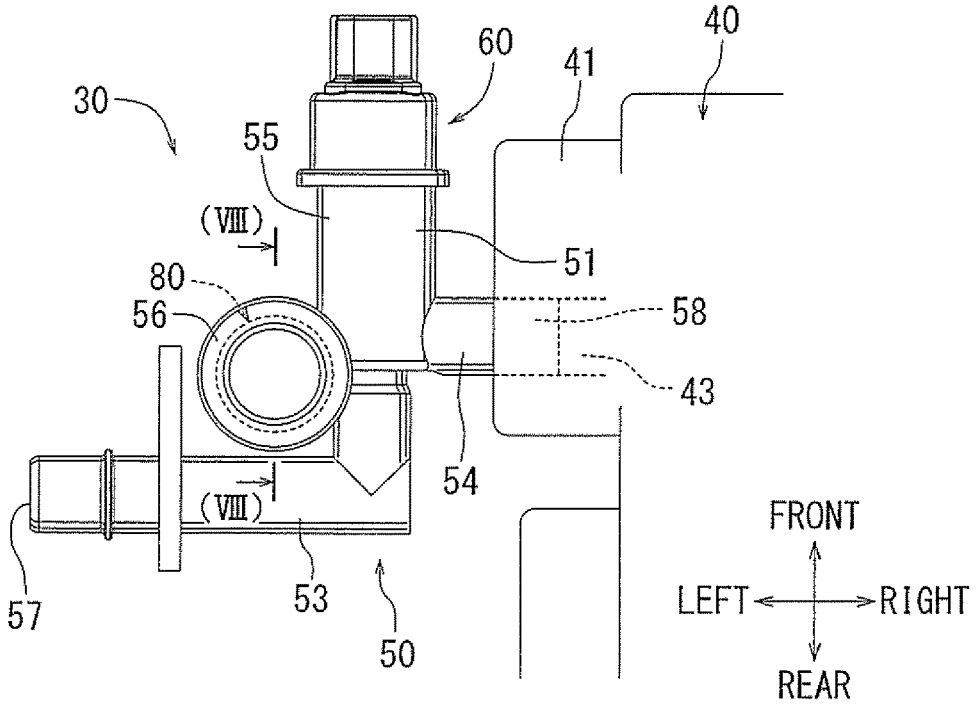
FIG. 5 is a plan view of the closing valve device.
Figure 6:
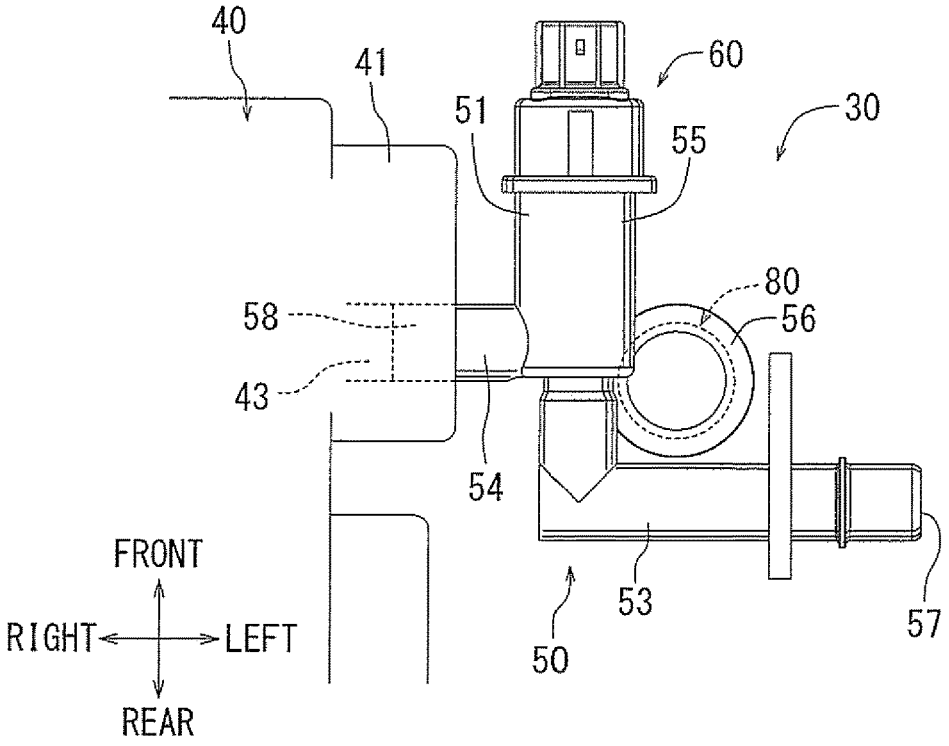
FIG. 6 is a bottom view of the closing valve device.

A representative embodiment is now described with reference to the drawings. Referring to FIG. 1, there is shown a fuel vapor processing apparatus 30 that may include a canister 40 and a closing valve device 50 integrated with each other. Referring to FIG. 2, there is shown an engine system 10 to which the fuel vapor processing apparatus 30 may be mounted. More specifically, the fuel vapor processing apparatus 30 may be assembled into the engine system 10, where engine system 10 may comprise a vehicle engine system. As shown in FIG. 2, in some embodiments the engine system 10 generally includes an engine 11 and a fuel tank 12. The engine 11 may be an internal combustion engine. The fuel tank 12 may store fuel that may be supplied to the engine 11. The fuel tank 12 may include an inlet pipe 13. The upper end of the inlet pipe 13 may include a refueling port, through which fuel may be filled into the fuel tank 12. A tank cap 14 may be detachably mounted to the refueling port. A breather pipe 15 may serve to provide fluid communication between the inside of the upper end of the inlet pipe 13 and a gaseous space or chamber disposed in the fuel tank 12.

In certain embodiments, a fuel supply device 16 is disposed within the fuel tank 12 and may generally include a fuel pump 17, a sender gauge 18 and a tank internal pressure sensor 19. The fuel pump 17 may pump the fuel stored within the fuel tank 12 and may discharge the pressurized fuel. The sender gauge 18 may detect the fuel level within the fuel tank 12. The tank internal pressure sensor 19 may detect the internal pressure within the fuel tank 12 as a relative value compared to the atmospheric pressure. The fuel pumped by the fuel pump 17 from within the fuel tank 12 may be supplied to the engine 11 via a delivery pipe 22 and an intake air passage 23. The delivery pipe 22 may have a plurality of injectors (i.e., fuel injection valves) 21, the number of which may correspond to the number of combustion chambers of the engine 11, so that the fuel may be injected into the intake air passage 23 through the plurality of injectors 21. An air cleaner 24, an airflow meter 25, a throttle valve 26, etc. may be disposed in the intake air passage 23.

In this embodiment, the fuel vapor processing apparatus 30 may generally include a vapor passage 31, a purge passage 32, a canister 40 and the closing valve device 50. The closing valve device 50 may be mounted to the canister 40 so as to be integrated therewith. The closing valve device 50 may be connected to the downstream end of the vapor passage 31. The upstream end of the vapor passage 31 may be connected to the fuel tank 12 so as to communicate with the gaseous space defined in the fuel tank 12. The upstream end of the purge passage 32 may be connected to the canister 40 for communication with the inside of the canister 40. The downstream end of the purge passage 32 may be connected to the intake passage 23 at a position on the downstream side of the throttle valve 26.

The canister 40 may adsorb fuel vapor and may allow for desorption of fuel vapor. More specifically, the canister 40 may include a canister case 41 and an adsorbent (no shown) contained in the canister case 41 (shown in FIG. 2). The adsorbent may adsorb fuel vapor and may allow for desorption of fuel vapor. The adsorbent may be formed of activated carbon or any other suitable material. As shown particularly in FIG. 1, the canister case 41 may include a tank port 43, a purge port 44 and an atmospheric port 45 each having a tubular shape. Each of the tank port 43, the purge port 44 and the atmospheric port 45 may have an opening that is in communication with the inside of the canister case 41. The tank port 43 may be connected to the vapor passage 31 via the closing valve device 50. The purge port 44 may be connected to the purge passage 32 and to the engine 11. The atmospheric port 45 may be connected to an atmospheric passage 36 that is open to the atmosphere.

As shown particularly in FIG. 2, an on-board refueling vapor recovery valve (hereinafter called "ORVR valve") 27 and a fuel cut-off valve 28 may be disposed within the gaseous space defined in the fuel tank 12 and may be connected to the upstream end of the vapor passage 31. The ORVR valve 27 may comprise a filling-up preventing valve. The filling-up preventing valve may include a float valve (not shown) that may be opened and closed according to the movement of a float (not shown) floating on the fuel surface disposed therein due to its buoyancy. Should the fuel level of the fuel tank 15 be less than a full level, the float valve may be opened. Should the fuel tank 15 need be refueled until the fuel surface level is raised to the full level, the float valve may be closed, so that the vapor passage 31 may be shut off. When the vapor passage 31 is shut off by the ORVR valve 27, the inlet pipe 13 may be partially filled with fuel to activate an auto stop mechanism of a fuel supply gun (not shown) for stopping the supply of fuel. The fuel cut-off valve 28 may also include a float valve (not shown) that may be opened and closed according to the movement of a float (not shown) floating on the fuel surface due to its buoyancy. The float valve may be normally maintained in the open position. The float valve may be closed for preventing fuel in the fuel tank 12 from flowing into the vapor passage 31, for example, when the vehicle has accidentally overturned.

A purge valve 35 may be disposed in the purge passage 32 at a position disposed along the purge passage 32. The purge valve 35 may be opened and closed under the control of an ECU (engine control unit) (not shown) such that the degree or amount of valve-opening of the purge valve 35 corresponds to the flow rate of purge gas that comprises fuel vapor containing gas to be purged to the engine 11, calculated by the ECU, whereby a so-called purge control may be performed. The purge valve 35 may include a stepping motor (not shown) and a controller (not shown) to adjust a degree or amount of valve-opening amount of a valve member (not shown) by controlling a stroke movement of the valve member. Alternatively, the purge valve 35 may include an electromagnetic valve or a solenoid valve that may be closed in a non-exited state and may be opened when exited.

The inside of the canister 40 may communicate with the atmosphere via the atmospheric passage 36. An air filter 37 may be disposed in the atmospheric passage 36 at a position along the atmospheric passage 36.

The fuel vapor produced in the fuel tank 12 may flow into the canister 40 via the vapor passage 31 and may be adsorbed by the adsorbent contained in the canister 40. For example, if the internal pressure within the fuel tank 12 is higher than the atmospheric pressure when the vehicle is not traveling (e.g., during parking of the vehicle or when the vehicle is at rest, etc.), a motor operated valve 60 of the closing valve device 50 may be opened to allow flow of the fuel vapor into the canister 40 via the vapor passage 31. On the other hand, if a predetermined purge condition is established during traveling of the vehicle, the purge valve 35 may be opened, so that a negative pressure of intake air produced in the intake passage 23 of the engine 11 may be communicated to the interior of the canister 40 via the purge passage 32. As a result, the fuel vapor adsorbed by the canister 34 may be desorbed and purged to the intake passage 23 together with the atmospheric air supplied via the atmospheric passage 36. The purge gas purged to the intake passage 23 may flow into the engine 11, so that fuel contained in the purge gas may be burned in the engine 11.

The closing valve device 50 may be integrated with a part of the canister 40 on the side of the vapor passage 31 that connects the closing valve device 50 to the fuel tank 12 so that the closing valve device 50 may open and close for allowing and preventing flow of fuel vapor into and out of the canister 40. The closing valve device 50 may include a motor operated valve 60 and a relief valve 80. The relief valve 80 may be a mechanical valve that automatically operates according to a pressure of the fuel vapor as will be explained later.

Referring to FIGS. 3-10, the closing valve device 50 may include a valve housing 51. The valve housing 51 may be a resin molded one-piece product. The valve housing 51 may include a first tube portion 53, a second tube portion 54, a first tubular housing portion 55 and a second tubular housing portion 56 that are formed integrally with each other. The first tube portion 53 and the second tube portion 54 may have cylindrical tubular shapes and may have the same or substantially the same diameter with each other. The first tube portion 53 may have a tank side port (i.e., an upstream side end port) 57 that can be connected to the vapor passage 31 for communication with the fuel tank 12. The tank side port 57 will be hereinafter also referred to as a tank-side port 57. In this embodiment, the first tube portion 53, the second tube portion 54 and the first tubular housing portion 55 may extend along a first axis, a second axis and a third axis, respectively, which are positioned substantially within the same plane. More specifically, the first axis and the second axis may extend substantially parallel to each other, and the third axis may extend substantially perpendicular to the first and second axes. The second tube portion 56 may extend along a fourth axis that may be perpendicular to the plane of the first, second and third axes.

The second tube portion 54 may have a canister side port (i.e., a downstream side end port) 58 that can be directly connected to the tank port 43 of the canister 40. The canister side port 58 may be connected to the tank port 43 by a suitable connecting technique, such as threadable engagement, or press-fitting of the canister side port 58 into the tank port 43. In this way, the tank port 43 of the canister 40 may be directly connected to the closing valve device 50 without intervention of any other passage device.

Figure 7:
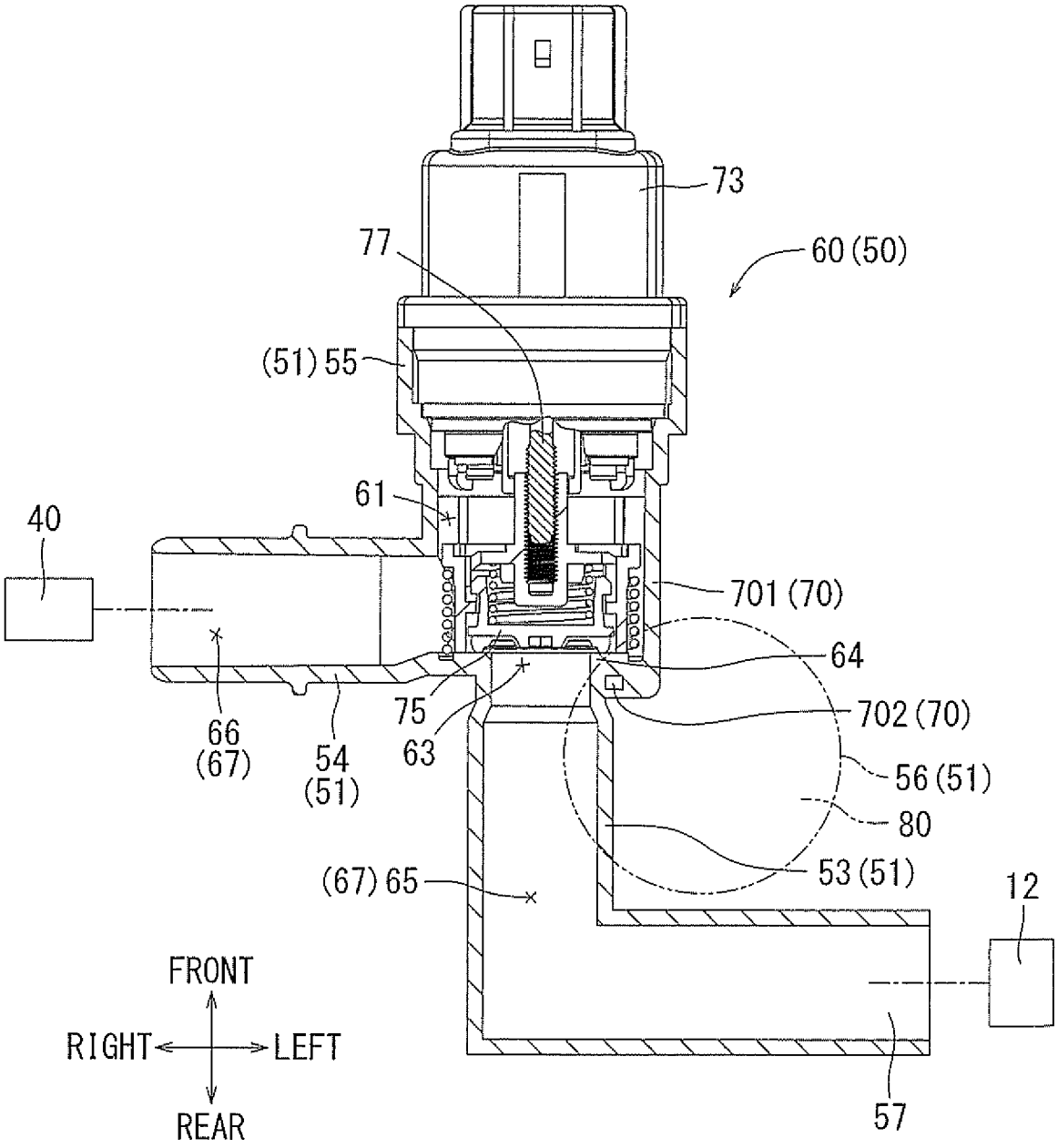
FIG. 7 is cross sectional view taken along line VII-VII in FIG. 4.

The first tubular housing portion 55 may serve as a valve housing of the motor operated valve 60. The second tubular housing portion 56 may serve as a valve housing of the relief valve 80. As shown in FIG. 7, a first valve chamber 61 may be defined within a rear portion of the first tubular housing portion 55 and may communicate within the first tube portion 53 and the second tube portion 54, so that a first passage 65 defined in first tube portion 53 and a second passage 66 defined in the second tube portion 54 may communicate with each other via the first valve chamber 61. A first valve opening 63 may be formed in one end of the first tube portion 53 on the side of the first valve chamber 61. In one embodiment, the inner diameter of the first valve opening 63 may be slightly smaller than the inner diameter of the remaining portion of the first tube portion 53. The open edge of the first valve opening 63 may form a valve seat 64. The first passage 65 may extend rearward in an axial direction from the first valve opening 63 and may then be bent leftward in a direction substantially perpendicular to the axial direction. The second passage 66 may extend rightward from the first valve chamber 61 (i.e., in a direction opposite to the extending direction of the leftward bent portion of the first passage 65). In this way, the first passage 65, the second passage 66, and the first valve chamber 61 may jointly form a fuel vapor passage 67 serving as a main passage and having a crank shape. The fuel vapor passage 67 may be opened and closed by the operation of the motor operated valve 60. In other words, the motor operated valve 60 may control the flow of fuel vapor through the fuel vapor passage 67.

Figure 8:
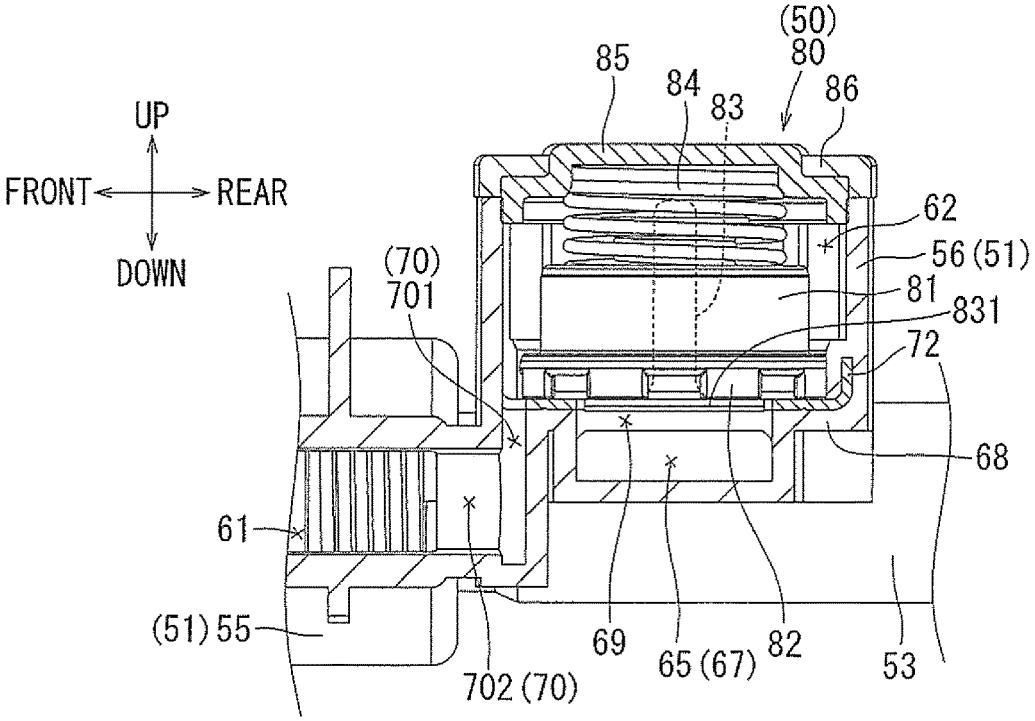
FIG. 8 is a cross sectional view taken along line VIII-VIII in FIG. 5.

As shown in FIG. 8, the lower portion of the second tubular housing portion 56 may include a stepped portion 68. The stepped portion 68 may be aligned coaxially with the second tubular housing portion 56, and may have a smaller inner diameter than that of the second tubular housing portion 56. The internal space of the stepped portion 68 may define a second valve opening 69 that is in communication with the second valve chamber 62. The second valve opening 69 is in communication with a part of the first passage 65 at a position between the first tube portion 63 and the second tubular housing portion 56. A valve seat 72 may be disposed at an end surface of the stepped portion 68 extending in a radial direction and facing the second valve chamber 62. The valve seat 72 may comprise a metallic material and may have an annular shape coaxial with the stepped portion 68.

The inner diameter of the valve seat 72 may be the same or substantially the same as the inner diameter of the stepped portion 68. The radially outer circumferential edge of the valve seat 72 may be embedded into a wall of the second tubular housing portion 56. A vertical passage portion 701 may be formed in the front end portion of the second tubular housing portion 56 and may extend vertically therewithin. The upper end of the vertical passage portion 701 may be in communication with the second valve chamber 62. To this end, the vertical passage portion 701 may extend through and across the valve seat 72. A horizontal passage portion 702 may be formed in the left end portion of the first tubular housing portion 55 and may extend horizontally in the front-to-rear direction. The front end of the horizontal passage portion 702 may be in communication with the first valve chamber 61. The rear end of the horizontal passage portion 702 may be in communication with the lower end of the vertical passage portion 701. The second valve opening 69, the second valve chamber 62, the vertical passage portion 701, the horizontal passage portion 702 and the first valve chamber 61 may jointly define a sub passage 70 that bypasses the first valve opening 63. Thus, the sub passage 70 is defined in the valve housing 51 and may serve as a fuel vapor passage that communicates with the fuel vapor passage 67 (i.e., the main passage) while bypassing the motor operated valve 60.

Figure 9:
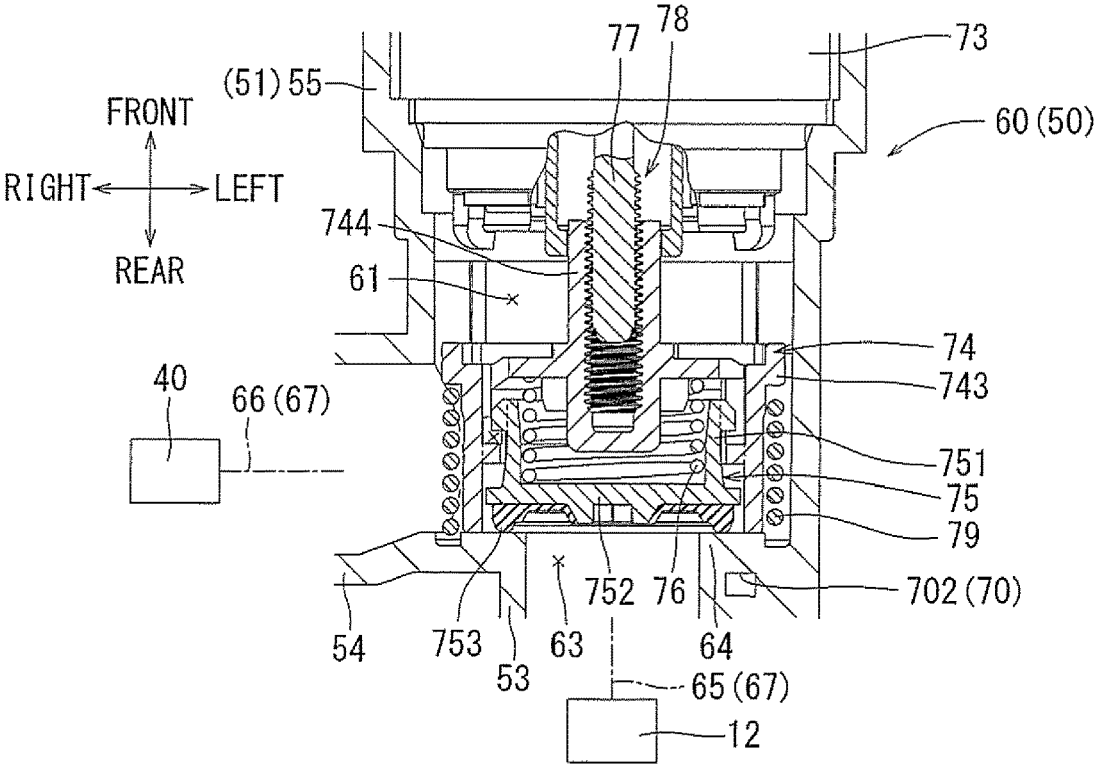
FIG. 9 is a cross sectional view of an embodiment of a motor operated valve of the closing valve device and showing a closed position of the motor operated valve.
Figure 10:
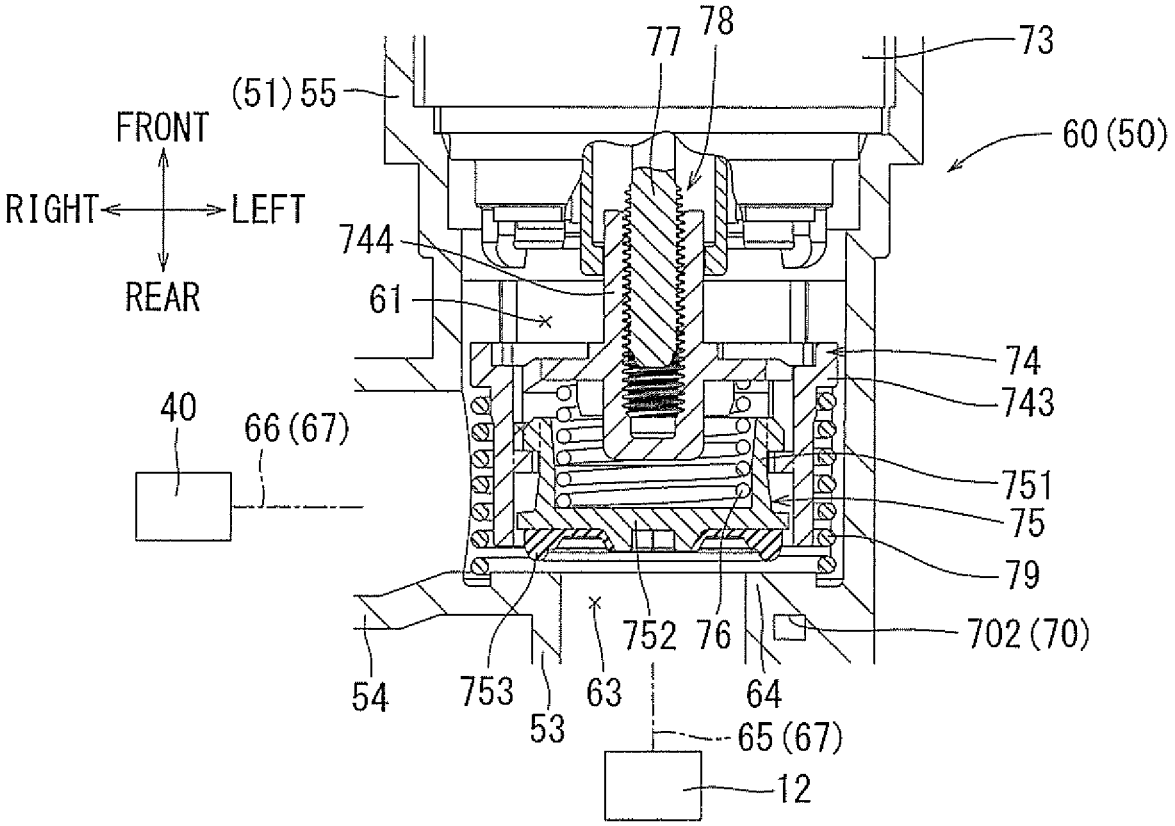
FIG. 10 is a cross sectional view of the motor operated valve showing an open position of the motor operated valve.

As shown in FIGS. 9 and 10, the motor operated valve 60 may be disposed and supported within the first tubular housing 55. As described previously, the first tubular housing 55 is a part of the valve housing 51. More specifically, the first tubular housing 55 may serve as a motor support portion for supporting a stepping motor 73 of the motor operated valve 60. Therefore, the closing valve device 50 may be integrated with the canister 40 by connecting the canister side port 58 of the second tube portion 54 (i.e., a different element from the first tubular housing portion 55 serving as the motor support portion) to the canister case 41.

The motor operated valve 60 may generally include the stepping motor 73, a valve guide 74, a valve member 75 and a valve spring 76. The stepping motor 73 may be disposed within the first tubular housing 55 with the axial direction of the stepping motor 73 oriented in the front-rear direction. The stepping motor 73 may include an output shaft 77 that can rotate both in a first, normal direction and a second, reverse direction. The output shaft 77 may be oriented in the rear direction and may be coaxially disposed within the first valve chamber 61. A male thread may be formed on the outer circumferential surface of the output shaft 77. The stepping motor 73 may include a brush-less motor (not shown) as a drive motor that rotatably drives the output shaft 77.

The valve guide 74 may be disposed within the first valve chamber 61 such that it can move in the axial direction (i.e., the front-rear direction). The valve guide 74 may be prevented from rotating about its axis relative to the circumferential wall of the first valve chamber 61 (i.e., the first tubular housing 55) by a suitable rotation preventing device (not shown). The valve guide 74 may include an enlarged portion 753 that may be loosely fitted into the inner circumferential wall of the first valve chamber 61 with a given clearance. The valve guide 74 may further include a tubular shaft portion 744. The inner circumferential surface of the tubular shaft portion 744 may have a female thread formed thereon. The female thread portion may be in engagement with the male thread portion of the output shaft 77 of the stepping motor 73. Therefore, the valve guide 74 may move forward or rearward in an axial direction as the output shaft 77 rotates in the normal direction or the reverse direction. The male thread portion of the output shaft 77 and the female thread portion of the valve guide 74 may jointly form a feeding screw mechanism 78.

An auxiliary spring 79 may be disposed on a radially outer side of the valve guide 74 so as to be interposed between the enlarged portion 743 and a part disposed around the valve seat 64 of the first tube portion 53. The auxiliary spring 79 may normally bias the valve guide 74 in the forward direction to inhibit potential backlash of the feeding screw mechanism 78. The valve member 75 may include a cylindrical tubular portion 751 and a valve plate portion 752 for closing the rear opening of the tubular portion 751. A first seal member 753 may be fitted on the valve plate portion 752. The first seal member 753 may have an annular shape and may be made of elastic material such as rubber. The valve member 75 may be coaxially disposed within the valve guide 74 so as to be movable in the front-rear direction. The first seal member 753 may be opposed to the valve seat 64 so as to be able to contact the valve seat 64. The valve member 75 may be supported within the valve guide 74 such that the valve member 75 can move within a predetermined range in the axial direction (the front-rear direction) while being prevented from rotation relative to the valve guide 74. The valve spring 76 may be a coil spring that normally biases the valve member 75 in a closing direction relative to the valve guide 74.

When the stepping motor 73 is driven to rotate the output shaft 77 in a valve closing direction from a valve opening state of the motor operated valve 60 (where the valve member 75 is positioned away from the valve seat 64), the valve guide 74 may move rearward together with the valve member 75 by the action of the feeding screw mechanism 78, so that the valve member 75 may be seated on the valve seat 64 to provide a valve closing state. The valve guide 74 may move further rearward relative to the valve member 75 by a given distance to reach a fully closing or closed position after the valve member 75 has seated on the valve seat 64. On the other hand, when the stepping motor 73 is driven to rotate the output shaft 77 in a valve opening direction (opposite to the valve closing direction) from the valve closing state, the valve guide 74 may move forward from the fully closing position relative to the valve seat 64 by the action of the feeding screw mechanism 78, so that the valve member 75 may move forward together with the valve guide 74 away from the valve seat 64 after the valve member 75 has moved forward by the given distance. In this way, the valve member 75 may be brought to an open state. The valve closing direction may be the normal rotational direction of the output shaft 77 or may be the reverse direction.

As shown in FIG. 8, a relief valve 80 may be supported within the second tubular housing 56 that is a part of the valve housing 51. The relief valve 80 may serve to control the flow of the fuel vapor through the sub passage 70 according to the pressure of the fuel vapor disposed therein. Although not shown in detail in the drawings, the relieve valve 80 may include a positive pressure relief valve mechanism and a negative pressure relief valve mechanism. More specifically, the positive and negative pressure relief valve mechanisms may be coaxially disposed within the second valve chamber 62. The positive pressure relief valve mechanism may include a first valve member 81 vertically movably disposed within the second valve chamber 62 of the second tubular housing 56. The negative pressure relief valve mechanism may include a second valve member 83 vertically movably disposed within the first valve member 81. A seal member 82 may be attached to the lower end of the first valve member 81 and may vertically oppose the valve seat 72, so that the first valve member 81 may be in a closed position when the outer peripheral portion of the seal member 82 contacts the upper surface of the outer peripheral portion of the valve seat 72. A first coil spring 84 may bias the first valve member 81 downward toward the closed position. The second valve member 83 may include a valve plate 831 that may be vertically opposed to the lower surface of the inner peripheral portion of the seal member 82, so that the second valve member 81 may be in a closed position when the valve plate 831 contacts the lower surface of the inner peripheral portion of the seal member 82. A second coil spring (not shown) may bias the second valve member 83 upward relative to the first valve member 81 such that the valve plate 831 moves upward toward the closed position. Therefore, when the pressure within the second valve opening 69 (i.e., the pressure on the side of the fuel tank) exceeds a predetermined positive-side valve opening pressure determined by the biasing force of the first coil spring 84, the first valve member 81 may be opened to release the pressure. On the other hand, when the pressure within the second valve opening 69 becomes lower than a predetermined negative-side valve opening pressure determined by the biasing force of the second coil spring, the second valve member 83 may be opened to release the pressure. The second tubular housing 56 may have an upper open end that may be closed by a cap 85. A peripheral member 86 may prevent the cap 85 from being removed from the open upper end of the second tubular housing 56.

As described above, according to the fuel vapor processing apparatus 30 of this embodiment, the motor operated valve 60 may be disposed and supported within the valve housing 51. The valve housing 51 may be integrated with the canister case 41 that serves as an outer casing of the canister 40. In this arrangement, the canister 40 and the motor operated valve 60 can be handled or manipulated as a single component. Hence, the canister 40 and the motor operated valve 60 can be easily mounted to a vehicle. Further, due to integration of the canister 40 and the motor operated valve 60, it may be possible to simplify the piping structure of the purge passage 32, etc. Hence, it may be possible to minimize a loss in pressure of the fuel vapor flowing through the purge passage 32, etc. Furthermore, it may be possible to reduce the resistance against flow of fuel during a refueling operation.

Furthermore, in the above embodiment, the canister side port 58 of the valve housing 51 may be directly connected to the tank port 43 of the canister 40. Therefore, it may be possible to minimize a distance between the closing valve device 50 and the canister 40. Further, it may be possible to reduce an amount of fuel vapor remaining between the closing valve device 50 and the canister 40 when the closing valve device 50 is closed. It may be also possible to reduce a passage cross-sectional area of the second tube portion 54, etc. and to minimize the size of the stepping motor 73 that drives the valve member 75.

Furthermore, in the above embodiment, the relief valve 80 may be disposed in the sub passage 70. More specifically, the relief valve 80 may be disposed and supported within the valve housing 51. Therefore, the canister 40 and the closing valve device 50 including the relief valve 80 may be integrated with each other. Hence, the fuel vapor processing apparatus 30 including the closing valve device 50 and the relief valve 80 can be easily mounted to a vehicle.

Furthermore, in the above embodiment, a connecting portion of the valve housing 51 for connecting to the canister case 41 may be set to the canister side port 58 of the second tube portion 54, which is a different element from the first tubular housing portion 55 serving as the motor support portion. Therefore, it may be possible to inhibit or minimize transmission to the canister 40 of noises or vibrations generated by the stepping motor 73. As a result, it may be possible to reduce noises and vibrations of the fuel vapor processing apparatus 30.

The above embodiment may be modified in various ways. For example, the internal structure of the canister 40 may not be limited to that of the above embodiment. In addition, the construction of the engine system 10 may not be limited to that disclosed in the above embodiment. Further, the stepping motor 73 may be replaced with any other motor drive device.

The various examples described above in detail with reference to the attached drawings are intended to be representative of the disclosure and thus not limiting. The detailed description is intended to teach a person of skill in the art to make, use and/or practice various aspects of the present teachings and thus is not intended to limit the scope of the disclosure. Furthermore, each of the additional features and teachings disclosed above may be applied and/or used separately or with other features and teachings to provide improved fuel vapor processing apparatuses, and/or methods of making and using the same.

Moreover, the various combinations of features and steps disclosed in the above detailed description may not be necessary to practice the disclosure in the broadest sense, and are instead taught to describe representative examples of the disclosure. Further, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed as informational, instructive and/or representative and may thus be construed separately and independently from each other. In addition, all value ranges and/or indications of groups of entities are also intended to include possible intermediate values and/or intermediate entities for the purpose of original written disclosure, as well as for the purpose of restricting the claimed subject matter.

What is claimed is:

1. A fuel vapor processing apparatus comprising:

a canister comprising a canister case and configured to adsorb fuel vapor and to allow desorption of fuel vapor; and a valve device comprising:

a valve housing defining a fuel vapor passage therein; and a first valve disposed within the valve housing and having a first valve axis, the first valve configured to control a flow of fuel vapor through the fuel vapor passage, wherein:

the valve housing is directly connected to the canister case, so that the fuel vapor passage communicates within the canister case;

the valve housing further comprises a tank-side port and a canister-side port defining a tank-side opening and a canister-side opening, respectively, the fuel vapor passage is in communication with the tank-side opening and the canister-side opening, the tank-side port is configured to be connected to a fuel tank;

the canister case comprises a tank port and a purge port;

the canister-side port of the valve housing is directly connected to the tank port of the canister;

the purge port of the canister case is configured to be connected to an engine via a purge passage;

the tank-side port of the valve housing extends along a first port axis;

the purge port of the canister case extends along a second port axis; and the first port axis and the second port axis are parallel to each other;

the valve housing further comprises a sub passage defined therein and connected to the fuel vapor passage so as to bypass the first valve;

the fuel vapor processing apparatus further comprises a second valve disposed within the valve housing and configured to control a flow of fuel vapor through the sub passage according to a pressure of the fuel vapor flowing through the sub passage:

the second valve is a mechanical valve having a second valve axis extending perpendicular to the first valve axis;

the canister case has a length, a width extending from a front to a rear of the canister, and a height in directions perpendicular to each other;

the height of the canister case is smaller than both the length and the width of the canister case;

the first valve axis extends towards the front of the canister case and the second valve axis extends in the direction of the height of the canister case; and the tank-side port is positioned between the canister-side port and the rear of the canister.

2. The fuel vapor processing apparatus according to claim 1, wherein the first valve is a motor-operated valve.

3. The fuel vapor processing apparatus according to claim 1, wherein the second valve automatically operates according to the pressure of the fuel vapor flowing through the sub passage.

4. The fuel vapor processing apparatus according to claim 1, wherein the valve housing comprises a first tube portion having the tank-side port, a second tube portion having the canister-side port, and a first tubular housing portion connected between the first tube portion and the second tube portion and defining a first valve chamber configured to receive the first valve.

5. The fuel vapor processing apparatus according to claim 4, wherein the first tube portion, the second tube portion, and the first tubular housing portion extend along a first axis, a second axis and a third axis, respectively.

6. The fuel vapor processing apparatus according to claim 5, wherein the first axis, the second axis, and the third axis are positioned substantially within a same plane.

7. The fuel vapor processing apparatus according to claim 5, wherein the first axis and the second axis extend substantially parallel to each other, and the third axis extends substantially perpendicular to the first and second axes.

8. The fuel vapor processing apparatus according to claim 2, wherein:

the motor operated valve comprises a valve seat and a valve member disposed in the fuel vapor passage, and an electric motor coupled to the valve member and configured to move the valve member to change a position of the valve member relative to the valve seat so that the fuel vapor passage is opened and closed according to a change of the position of the valve member; and the valve housing further comprises a motor support portion configured to support the electric motor of the motor operated valve;

the valve housing is connected to the canister case via a connecting portion of the valve housing; and the connecting portion comprises a different portion than the motor support portion.

9. The fuel vapor processing apparatus according to claim 1, wherein:

the valve housing comprises a first tube portion having the tank-side port, a second tube portion having the canister-side port, a first tubular housing portion connected between the first tube portion and the second tube portion and defining a first valve chamber configured to receive the first valve, and a second tubular housing portion connected between the first tube portion and the second tube portion, independently of the connection between the first tubular housing portion and the first tube portion and the second tube portion, and defining the sub passage configured to receive the second valve.

10. The fuel vapor processing apparatus according to claim 9, wherein the first tube portion, the second tube portion, the first tubular housing portion and the second tubular housing portion extend along a first axis, a second axis, a third axis and a fourth axis, respectively.

11. The fuel vapor processing apparatus according to claim 10, wherein the first axis, the second axis and the third axis are positioned substantially within a same plane, and the fourth axis extends substantially perpendicular to the plane of the first, second and third axes.

12. The fuel vapor processing apparatus according to claim 11, wherein the first axis and the second axis extend substantially parallel to each other, and the third axis extends substantially perpendicular to the first and second axes.

13. The fuel vapor processing apparatus according to claim 1, wherein the valve housing is a one-piece member.

14. The fuel vapor processing apparatus according to claim 13, wherein the valve housing is made of resin.

15. The fuel vapor processing apparatus according to claim 2, wherein:

the motor-operated valve comprises a motor having a motor axis; and the motor axis extends perpendicular to the first and second port axes.

16. The fuel vapor processing apparatus according to claim 3, wherein:

the second valve axis extends perpendicular to a plane within which the first and second port axes extend.

17. The fuel vapor processing apparatus according to claim 4, wherein:

the first tube portion, the second tube portion and the first tubular housing portion are formed integrally with each other.

18. The fuel vapor processing apparatus according to claim 9, wherein:

the second tubular housing portion is disposed on a side opposite to the second tube portion with respect to the first tubular housing portion.

19. The fuel vapor processing apparatus according to claim 11, wherein:

the sub passage is configured to detour the first valve chamber.

20. The fuel vapor processing apparatus according to claim 1, wherein:

the length of the canister case is measured in a direction parallel to the first and second port axes;

the width of the canister case is measured in a direction perpendicular to the first and second port axes; and the second valve axis extends perpendicular to a plane within which the first and second port axes extend.

21. The fuel vapor processing apparatus according to claim 20, wherein the canister case has a substantially parallelepiped shape.

* * * * *